United States Patent [19]

Edwards

[11] 4,240,623

[45] Dec. 23, 1980

[54] CIRCLE SWING

[76] Inventor: Paul A. Edwards, 35 E. Greenway Rd., Phoenix, Ariz. 85040

[21] Appl. No.: 923,717

[22] Filed: Jul. 12, 1978

[51] Int. Cl.[3] ..... A63G 1/20

[52] U.S. Cl. ..... 272/33 R; 272/38

[58] Field of Search ..... 272/33 R, 38, 49, 54, 272/55, 16, 17, 18, 85, 88, 89

[56] References Cited

U.S. PATENT DOCUMENTS

| | | | |
|---|---|---|---|
| 1,987,004 | 1/1935 | Eyerly | 272/49 |
| 2,723,120 | 11/1955 | Hackleman | 272/38 |
| 3,152,802 | 10/1964 | Heisler et al. | 272/33 R |
| 3,298,685 | 1/1967 | Williams | 272/33 R |
| 3,321,203 | 5/1967 | Hansen | 272/38 |
| 3,469,837 | 9/1969 | Heilig | 272/8 P |
| 3,885,788 | 5/1975 | Harris | 272/55 |
| 4,018,435 | 4/1977 | Howell | 272/33 R |
| 4,032,138 | 6/1977 | Willis | 272/33 R |

OTHER PUBLICATIONS

Space trainer, Hopkins Mfg. Corp., Dept. PP, 430 Peyton St., Emporid, Kan., Washington Star "Parade of Progress Section," Jan. 17, 1960, p. 13.

*Primary Examiner*—Richard C. Pinkham
*Assistant Examiner*—Arnold W. Kramer
*Attorney, Agent, or Firm*—Harry M. Weiss

[57] ABSTRACT

A swing having a hydraulically actuated counterweight which returns to a rest position which has relatively low potential energy when said swing is unoccupied. In addition to this safety feature the swing seat is surrounded by a circular frame to protect the rider and bystanders from possible injury.

4 Claims, 3 Drawing Figures

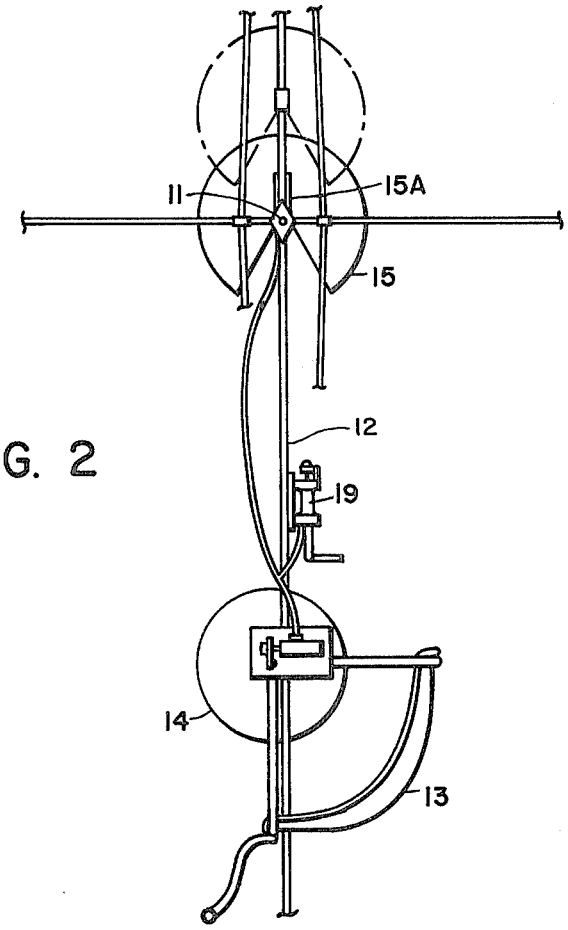
FIG. 2
FIG. 3
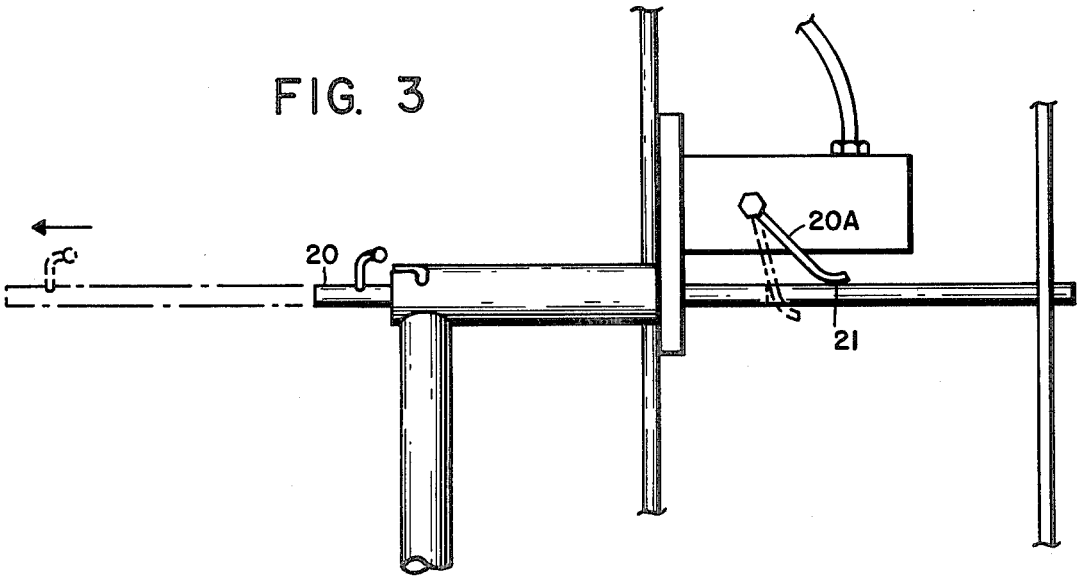

CIRCLE SWING

BACKGROUND OF THE INVENTION

This invention relates to a playground swing and more particularly to a swing which carries the occupant through a full 360° verticle circle, i.e. a circle swing.

In U.S. Pat. No. 3,298,685 there is disclosed a circle swing in which the counterweight for the swing seat is adjustably supported on a threaded shaft. Thus, the counterweight must be adjusted by trial and error and always remains at the adjusted position while a person mounts or dismounts from the swing. Also, in general, the counterweight will be left at some position away from the axis of rotation where it has a hazardous energy potential should the locking mechanism be disengaged. Also, the swing is unenclosed.

SUMMARY OF THE INVENTION

It is an object of the invention to improve the safety of a circle swing.

A further object of the invention is to provide a hydraulically actuated counterweight for a circle swing.

A still further object of the invention is to provide a circle swing having low potential for hazards to occupants and bystanders.

Yet a further object of the invention is to provide a circle swing which is enclosed.

In accordance with these objects there is provided a circle swing including a support frame having a horizontal pivot axis with a swing frame mounted on said support frame for full rotation about said pivot axis. A swing seat and actuating disc are mounted on said swing frame at a spaced distance on one side of the pivot axis and a hydraulically actuated counterweight mounted on the swing frame in diametric opposition to the swing seat. The swing seat is mounted pivotally to said swing frame and said actuating disc is mounted in fixed relationship with said swing frame. The counterweight is moveable between a position wherein its center of gravity is nearly adjacent to said pivot axis and a position outwardly therefrom to compensate for the weight of the swing seat occupant. The counterweight is actuated by a hydraulic pump mounted on the swing frame so as to be operable from the swing seat. The circle swing has a full circle configuration and a safety fence, thereby surrounding the same for safety of the occupant and bystanders.

The swing seat has a safety bar to retain the occupant therein with the safety bar and the hydraulically actuated counterweight interlocked so that the counterweight may only be moved away from the pivot axis when the occupant is secure in the swing seat.

Thus, in use of the swing, an occupant is seated in the swing, the safety bar is locked across the lap of the occupant. The counterweight is then moved away from the pivot axis by a hydraulic hand pump to compensate for the weight of the occupant. The occupant pushes or pulls the actuating disc to effect movement about the pivot axis. When the occupant brings the swing seat to position adjacent to the ground for completion of the ride, opening of the safety bar releases the hydraulic pressure returning the counterweight to a rest position near the pivot axis.

THE DRAWINGS

Further objects and advantages of the invention will be understood from the following complete description thereof and from the drawings wherein:

FIG. 2 is a side elevational view of a portion thereof; and

FIG. 3 is a front elevational view of a portion of FIG. 2.

COMPLETE DESCRIPTION

Figure 1:
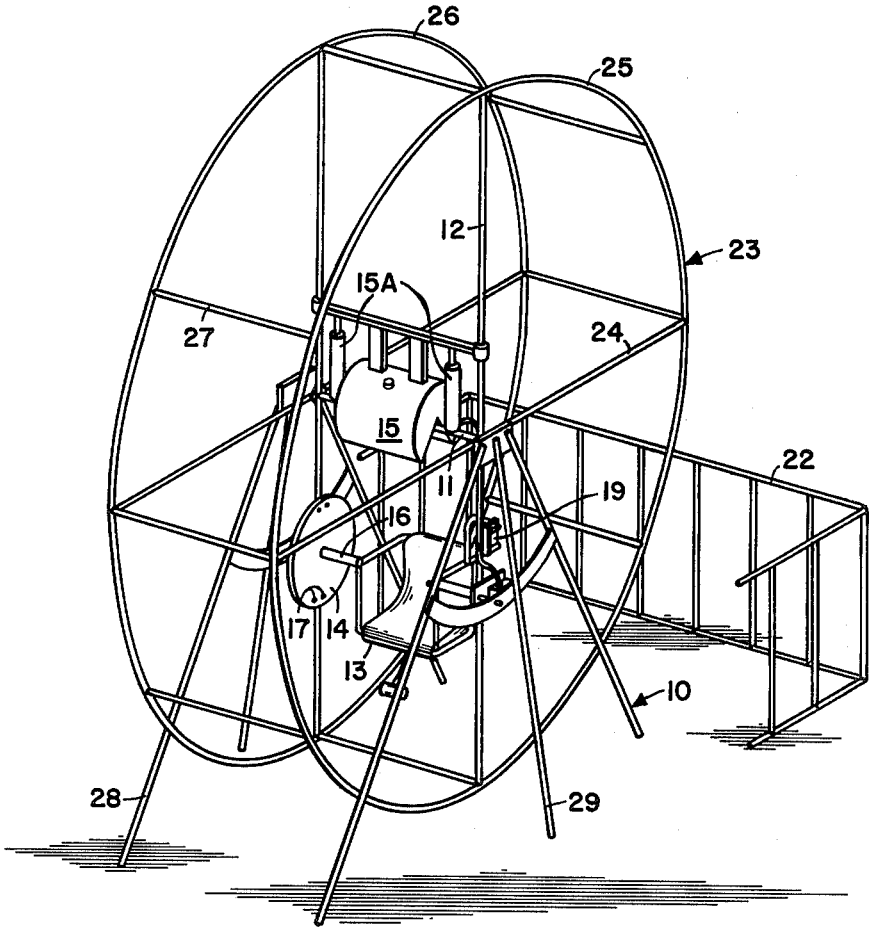
FIG. 1 is a perspective view of a circle swing in accordance with the invention.

As previously pointed out, U.S. Pat. No. 3,298,685 discloses a circle swing in which the counterweight for the swing seat is adjustably supported on a threaded shaft. Thus, the counterweight must be adjusted by trial and error and always remains at the adjusted position while a person mounts or dismounts from the swing. Also, in general, the counterweight will be left at some position away from the axis of rotation where it has a hazardous energy potential should the locking mechanism be disengaged. Also, the swing is unenclosed.

A circle swing in accordance with the invention includes a support frame 10 having a horizontal pivot axis 11. A swing frame 12 is mounted on the support frame 10 for rotation about the pivot axis 11. A swing seat 13 and actuating disc 14 are mounted on said swing frame 12 at a spaced distance from the pivot axis 11. A hydraulically actuated counterweight 15 is mounted on the swing frame 12 in diametric opposition to the swing seat 13.

The swing seat is mounted on a pivot axle 16 to the swing frame 12 and the actuating disc 14 is mounted in fixed relationship with said swing frame by securing means 17.

The counterweight 15 is moveable (FIG. 2) between a position wherein its center of gravity is nearly adjacent to the pivotal axis 11 and a position outwardly therefrom to compensate for the weight of the swing seat occupant. As is seen in FIG. 1, and shown in greater detail in FIG. 2, a portion of the mass of counterweight 15 extends below pivotal axis 11. This provision assures the safety of a person mounting or dismounting from the swing. With a portion of its mass below pivotal axis 11, counterweight 15 has its center of gravity more nearly coincident with said pivotal axis and any tendency for the counterweight to provide a turning moment about said axis so as to cause seat 13 to move and perhaps injure a person entering or leaving said seat is eliminated.

Preferably the counterweight is a water fillable tank for saving of shipping weight. The counterweight 15 is actuated by a hydraulic pump 19 mounted on the swing frame 12 so as to be operable from the swing seat 13. Normally, the pump is hand-actuated but could be power actuated if desired. The hydraulic fluid applies its pressure to cylinders 15A to effect movement of the weight to its desired counterbalancing position.

The safety bar 20 and the hydraulically actuated counterweight are interlocked at 21 whereby the counterweight may only be moved away from the pivot axis when the occupant is secure in the swing seat. A locking lever 20A secures the safety bar at either open or closed position.

Thus, in the use of the swing an occupant is seated in the swing seat 13. The safety bar 20 is locked across the lap of the occupant thereby permitting pressure to be applied to the counterweight by interlock valve 21. The counterweight 15 is moved away from the pivot axis 11 by a hydraulic hand pump 19 to compensate for the weight of the occupant. The occupant then pushes or pulls on actuating disc 14 to effect movement about the pivot axis 11. After finishing the ride, when the occupant brings the swing seat to position adjacent to the ground opening the safety bar 20 triggers interlock valve 21 and releases the hydraulic pressure returning the counterweight to a rest position near the pivot axis.

To protect the occupant and bystanders a fence 22 (FIG. 1) surrounds the entire circle swing. To further limit interference, the swing seat 13 and counterweight 15 are surrounded by a circular frame 23. This is accomplished most easily by extending the swing frame 12 beyond the extent of the seat and counterweight and providing an orthogonal support frame 24. Then, by connecting circular sections 25 and 26 the circular frame is completed. If desired cross-braces 27 may be added.

The support frame 10 is depicted as tripods 28 and 29 supporting either end of pivot axis 11. These, obviously, may be interconnected in any manner for additional structural support. Where strength is relatively unimportant as in the circular frame 23 plastic tubing may be used instead of iron pipe.

Thus, it will be seen that there is provided a circle swing in which the counterweight will not be left at some position away from the axis of rotation where it has a hazardous energy potential should the locking mechanism be disengaged. Also, the swing is enclosed for the safety of the occupant and bystanders.

Improvement in the safety of the circle swing is provided by a hydraulically actuated counterweight which returns to a rest position. If desired more than one swing seat may be provided.

While the invention has been disclosed by way of the preferred embodiment thereof, it will be appreciated that suitable modification may be made therein without departing from the spirit and scope of the invention.

What is claimed is:

1. A swing, comprising: a swing seat;

an adjustable counterweight;

support means whereby a person in said swing seat may, upon adjustment of said counterweight, be transported by said support means in an arc above a horizontal pivot axis;

said counterweight having a drum shaped body provided with a cutout portion lying along the longitudinal axis of said drum;

said horizontal pivot axis being located within said counterweight cutout portion while a person is mounting said swing seat;

means for maintaining the center of gravity of said counterweight nearly adjacent to said horizontal pivot axis while a person is mounting said swing seat; and interlock means for returning said counterweight by gravity when said seat is directly below said horizontal pivot axis to the position where its said center of gravity is nearly adjacent to said horizontal pivot axis before a person can dismount from said swing seat.

2. The swing of claim 1 further comprising:

hydraulic means for adjustment of said counterweight.

3. The swing of claim 2 further comprising:

control means for controlling said hydraulic means for adjusting said counterweight.

4. The swing of claim 3 further comprising:

mounting means for mounting said control means so as to be operable from said swing seat.

* * * * *